US005885124A

United States Patent [19]

Hattori

[11] Patent Number: 5,885,124

[45] Date of Patent: Mar. 23, 1999

[54] FABRICATION OF FIELD EMISSION ELEMENT WITH SMALL APEX ANGLE OF EMITTER

[75] Inventor: Atsuo Hattori, Hamamatsu, Japan

[73] Assignee: Yamaha Corporation, Japan

[21] Appl. No.: 778,454

[22] Filed: Jan. 3, 1997

[30] Foreign Application Priority Data

Jan. 8, 1996 [JP] Japan ..... 8-001039

[51] Int. Cl.[6] ..... H01J 9/02

[52] U.S. Cl. ..... 445/24; 445/50

[58] Field of Search ..... 445/24, 50

[56] References Cited

U.S. PATENT DOCUMENTS

| | | | |
|---|---|---|---|
| 5,141,459 | 8/1992 | Zimmerman | 445/24 |
| 5,203,731 | 4/1993 | Zimmerman | 445/24 |
| 5,334,908 | 8/1994 | Zimmerman | 313/336 |
| 5,720,641 | 2/1998 | Hattori | 445/24 |
| 5,720,642 | 2/1998 | Hattori | 445/24 |
| 5,749,762 | 5/1998 | Nakamoto et al. | 445/50 |

*Primary Examiner*—Kenneth J. Ramsey

*Attorney, Agent, or Firm*—Ostrolenk, Faber, Gerb & Soffen, LLP

[57] ABSTRACT

A method of fabricating a field emission element includes the steps of: forming an overhang portion in a substrate, the overhang portion including two opposing parts in cross section; depositing a sacrificial film on the overhang portion with two opposing parts, the sacrificial film including two opposing parts in cross section; chemically reacting the sacrificial film with two opposing parts to expand the volume of the sacrificial film and make the two opposing parts partially contact each other; depositing a field emission cathode film on the sacrificial film with contacted two opposing parts; and removing part of, or the whole of, the sacrificial film to expose a tip of the field emission cathode film.

16 Claims, 19 Drawing Sheets

FABRICATION OF FIELD EMISSION ELEMENT WITH SMALL APEX ANGLE OF EMITTER

BACKGROUND OF THE INVENTION a) Field of the Invention

The present invention relates to a manufacture method of a field emission element.

b) Description of the Related Art

A field emission element emits electrons from a sharp tip of an emitter by utilizing electric field concentration. For example, a flat panel display can be structured by using a field emitter array (FEA) having a number of emitters disposed on the array. Each emitter controls one pixel of the display.

FIGS. 16A and 16B illustrate conventional manufacture methods of a field emission element.

As shown in FIG. 16A, on a substrate 101 having a recess with a vertical side, a sacrificial film 103 is deposited by a deposition method having poor step coverage. The upper surface of the sacrificial film 103 has a tapered portion at the recess. An emitter electrode (cathode) 105 formed by using this sacrificial film 103 as a mold has a tip A. If the radius of curvature of the tip A of the emitter electrode 105 is large, an electric field is hard to concentrate and the electrical performance is not good.

As shown in FIG. 16B, if a sacrificial film 103 is deposited thick on a substrate 101 having a recess, two side wall parts in cross section of the sacrificial film 103 at the recess become partially in unison so that an emitter electrode 105 having a relatively small apex angle of the emitter tip can be formed.

With this method, it is necessary to deposit the sacrificial film thick so that the tip of the emitter electrode is formed at an upper position remote from the substrate 101. If a field emission element has a gate electrode in addition to an emitter electrode, this gate electrode is generally formed near at the boundary between the substrate 101 and the sacrificial film 103, although not shown in FIG. 16B, With the method illustrated in FIG. 16B, the emitter electrode 105 is formed remotely from the gate electrode so that a high drive voltage of the field emission element is required and the electrical performance is lowered.

A large radius of curvature of the emitter electrode tip makes an electric field hard to concentrate, lowering the performance of the field emission element. A relative position of the emitter and gate electrodes greatly influences the performance of the field emission element.

SUMMARY OF THE INVENTION

It is an object of the present invention to provide a manufacture method of a field emission element having a field emission cathode (emitter) with a small apex angle and radius of curvature of the emitter tip.

It is another object of the present invention to provide a manufacture method of a field emission element having a field emission cathode, capable of positioning an emitter tip with high precision.

According to one aspect of the present invention, there is provided a method of fabricating a field emission element comprising: a step of forming an overhang portion in a substrate, the overhang portion including two opposing parts in cross section; a sacrificial film depositing step of depositing a sacrificial film on the overhang portion with two opposing parts, the sacrificial film including two opposing parts in cross section; a reacting step of chemically reacting the sacrificial film with two opposing parts to expand the volume of the sacrificial film and make the two opposing parts partially contact each other; a depositing step of depositing a field emission cathode film on the sacrificial film with contacted two opposing parts; and an electrode exposing step of removing part of, or the whole of, the sacrificial film to expose a tip of the field emission cathode film.

The two opposing parts of the sacrificial film are made partially in contact with each other by chemical reaction. A sharp valley is formed at this contact area, the sharp valley having a cross section like two contacted circles. By using this valley as a mold, a field emission emitter having a small apex angle and radius of curvature of the emitter tip can be manufactured.

According to another aspect of the present invention, there is provided a method of fabricating a two-electrode field emission element wherein the reaction step of the first mentioned method is a step of chemically reacting only part of the sacrificial film to use the other part not chemically reacted as a gate electrode made of semiconductor or conductive material, the field emission cathode film is an emitter electrode made of conductive material, and the electrode exposing step is a step of exposing the tip of the emitter electrode and the head of the gate electrode.

The relative position of the emitter and gate electrode can be set precisely by properly selecting the process conditions of the step of depositing the sacrificial film on the overhang portion with opposing two parts and the step of chemically reacting the sacrificial film.

BRIEF DESCRIPTION OF THE DRAWINGS

FIG. 12A shows an emitter electrode having a needle-like tip, and FIG. 12B is a perspective view of an emitter electrode having a wedge-like tip extending in one direction.

DETAILED DESCRIPTION OF THE PREFERRED EMBODIMENTS

FIGS. 1A to 1G are diagrams illustrating the manufacture steps of a field emission element according to an embodiment of the invention. In the following, the manufacture steps of an emitter (cathode) constituting a field emission element will be described.

Figure 1A:
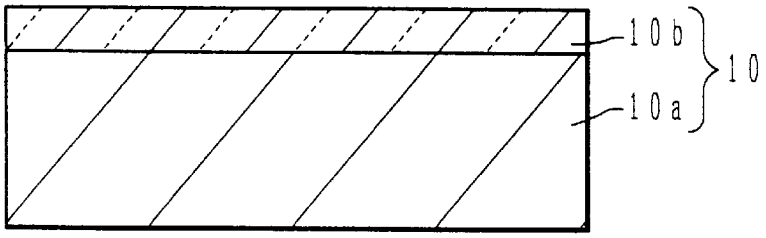
FIGS. 1A to 1G are diagrams illustrating the manufacture steps of a field emission element according to an embodiment of the invention.
Figure 1B:
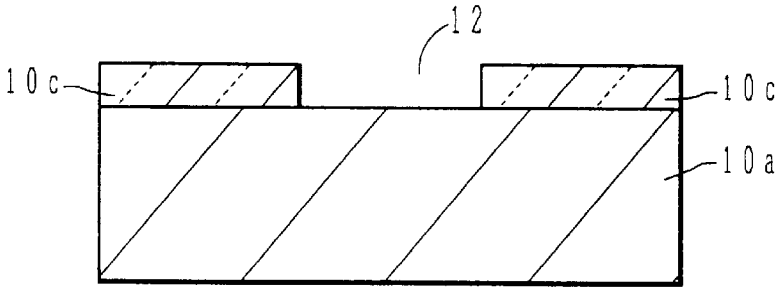

As shown in FIG. 1A, a substrate 10 is structured by a starting substrate 10*a* and a lamination film 10*b* of about 140 nm thick stacked upon the starting substrate 10*a*. For example, the starting substrate 10*a* is made of Si, and the lamination film 10*b* is made of $SiN_x$.

The lamination film 10*b* may be made of $SiO_2$ instead of $SiN_x$. The starting substrate 10*a* may be made of Al. If Al is used, the lamination film 10*b* is made of $AlN_x$, $Al_2O_3$, or the like. In the following, it is assumed that the starting substrate 10*a* is made of Si and the lamination film 10*b* is made of $SiN_x$.

A resist film having a predetermined pattern is formed on the lamination film 10*b*. By using the resist pattern as a mask, the lamination film 10*b* is selectively etched to form a hole 12 shown in FIG. 1B in the lamination film 10*b* so that a surface of the starting substrate 10*a* is exposed from an aperture of the hole 12. A lamination film 10*c* having two opposing parts in cross section is therefore formed. The hole 12 is circular as viewed down from the upper position and corresponds to a gate hole. The lamination film 10*c* is formed so as to surround the circular hole 12 as viewed down from the upper position. This selective etching is performed by reactive ion etching (RIF) using $SF_6$ containing etching gas. The hole 12 has a diameter of about 0.5 $\mu$m and a depth of about 140 nm.

Figure 1C:
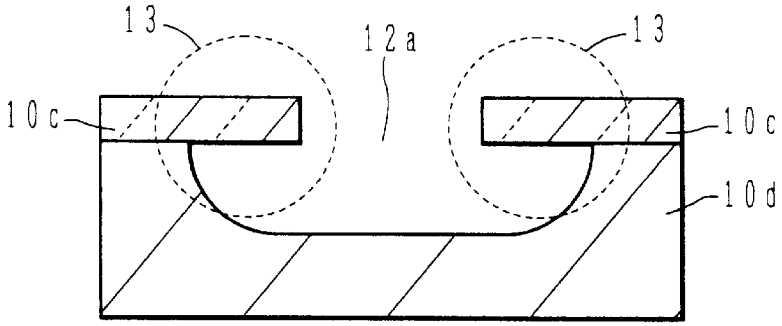

By using the lamination film 10*c* as an etching mask, the starting substrate 10*a* is wet etched to form a hote 12*a* in the starting substrate. A substrate 10*d* is therefore formed. The hole 12*a* forms a hollow space and has a diameter of about 1.5 $\mu$m and a depth of about 0.5 $\mu$m. Isotropical wet etching is performed through the hole 12 to etch the stating substrate 10*a* not only along the vertical direction of the substrate 10*a* but also along the horizontal direction in the cross-section of the starting substrate 10*a*. Therefore, the starting substrate 10*a* is etched partially at the underneath of the lamination film 10*c*. The lamination film 10*c* extends like a hood near at the hole 12*a*. As shown in FIG. 1C, an overhang portion 13 is therefore formed having two opposing parts in cross section separated along the horizontal direction of the substrate. The two opposing parts in section is called hereinafter simply "two parts".

As shown in FIG. 11D, a first sacrificial film 15*a* made of, for example, potysilicon is deposited by CVD about 0.3 $\mu$m thick on the lamination film 10*c* with two parts. This CVD is performed under the conditions of a temperature of 625° C., a pressure of 30 Pa, and a supply of $SiH_4$ diluted with lie at 0.6 slm. At the same time, a first sacrificial film 15*b* is also deposited through an opening on the substrate 10*d* at the bottom of the hole 12*a*. The first sacrificial film 15*a* also has two parts separated by a distance of about 0.1 $\mu$m.

The first sacrificial films 15*a* and 15*b* may be made of amorphous silicon, $WSi_x$, $MoSi_x$, $TaSi_x$, Al, Ta, Mo, or Ti, instead of polysilicon. Sputtering may be used instead of CVD. For example, the first sacrificial films 15*a* and 15*b* of amorphous silicon may be formed by a DC sputtering system using, as a target, polysilicon which contains P or B. For example, sputtering is performed under the conditions of a power of 1 kW and an Ar gas pressure of 8 mTorr.

Figure 1D:
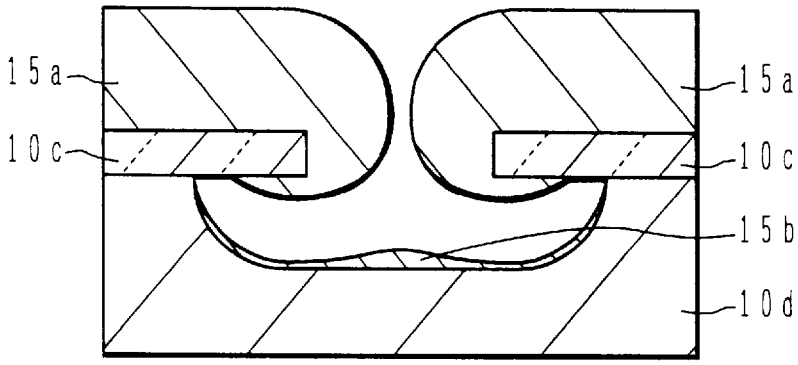
Figure 1E:
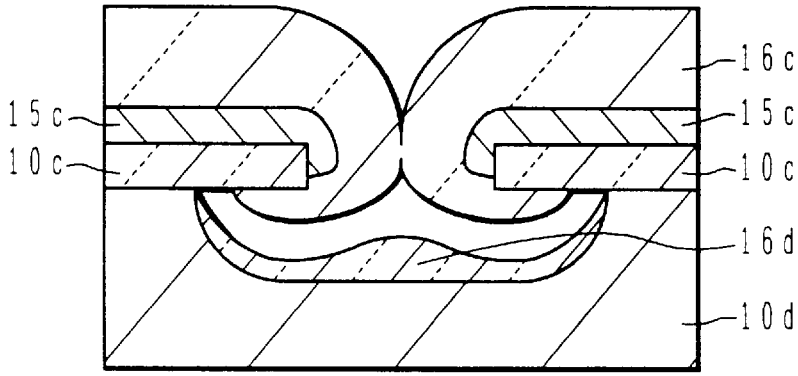

Next, as shown in FIG. 1E, the surfaces of the first sacrificial films 15*a* and 15*b* are oxidized by wet oxidation to form reacted films 16*c* and 16*d* made of, for example, $SiO_2$. The volume of the first sacrificial film 15*a* with two parts expands by about 0.1 $\mu$m by the oxidation and the two parts contact each other to form a continuous film of a reacted film 16*c* having only one part. The first sacrificial film 15*a* shown in FIG. 1D not oxidized forms a first sacrificial film 15*c*. In order to fill the space of 0.1 $\mu$m, the surface of the first sacrificial film 15*a* with two parts is expanded by 0.05 $\mu$m per one part. To obtain the surface volume expansion of 0.05 $\mu$m, polysilicon is oxidized by about 0.05 $\mu$m thick.

For example, wet oxidation is performed by using a vertical furnace under the conditions of a furnace temperature of 850° C., a supply of $H_2$ gas at 30000 cc/min, and a supply of $O_2$ gas at 20000 cc/min.

If the chemical reaction is stopped immediately after the two parts in cross section of the first sacrificial film contact each other by the volume expansion, a valley having an acute angle can be formed at the contact area. This contact area has an acute angle area having a cross section like two contacted circles or ellipses. If oxidation continues after the opening is closed, the contact point of the two parts of the sacrificial film gradually moves up. Even with this change, the apex angle at the contact area maintains an acute angle. By using this acute angle area as a mold, an emitter electrode is formed.

Figure 1F:
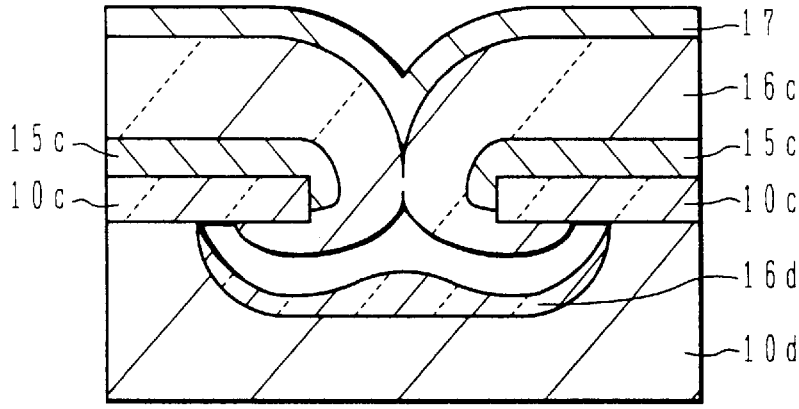

As shown in FIG. 1F, an emitter electrode 17 made of, for example, TiN is deposited on the reacted film 16*c* about 0.2 $\mu$m by reactive sputtering. For example, the reactive sputtering is performed by using a DC sputtering system under the conditions of a power of 5 kW, a pressure of 4 mTorr, a target of Ti, a supply of $N_2$ gas at 84 sccm, and a supply of Ar gas at 56 sccm. The emitter electrode 17 may be made of Mo, Cr, Ti, or W, instead of TiN.

Figure 1G:
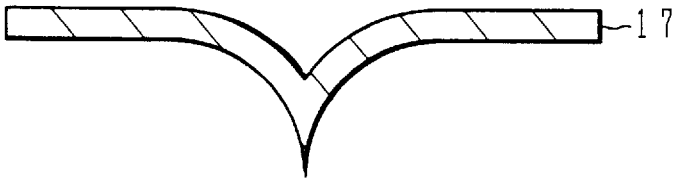

The substrate 10*d* is wet etched by $HF+HNO_3+H_2O$, and thereafter tsm reacted film 16*c* is wet etched by $HF+NH_4F$ to expose the tip of the emitter electrode as shown in FIG. 1G.

It can be predicted that the tip of the emitter electrode 17 has a projection of 0.3 to 0.8 $\mu$m high, an apex angle of about 20° and a radius of curvature of about 10 nm. With the manufacture method described above, the radius of curvature and apex angle or the tip or the emitter electrode 17 can be made small so that an electric field concentrates easily at the tip of the emitter electrode.

Figure 2A:
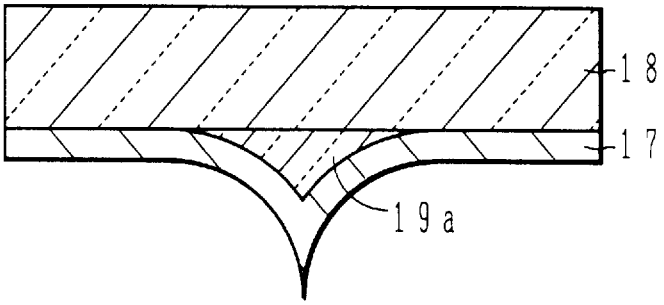
FIGS. 2A to 2C are diagrams illustrating three methods of reinforcing an emitter electrode with a support substrate.
Figure 2B:
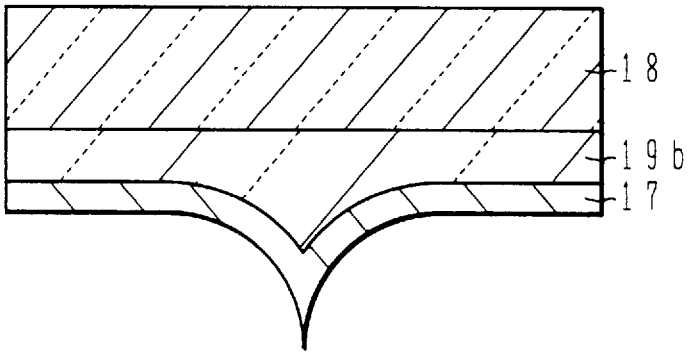
Figure 2C:
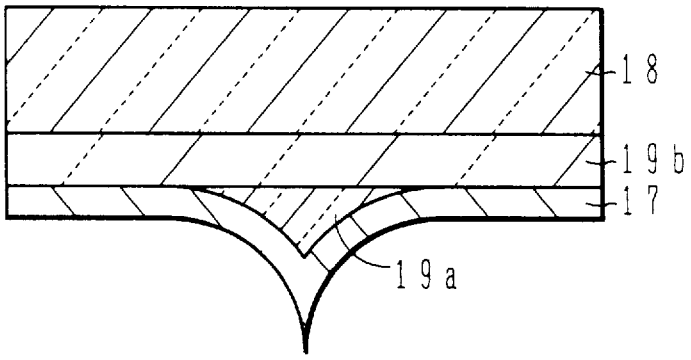

FIGS. 2A to 2C are diagrams illustrating three methods of reinforcing an emitter electrode 17 with a support substrate 18. Since the emitter electrode 17 is as thin as about 0.2 $\mu$m, it is desired to reinforce the emitter electrode 17 with the support substrate 18.

FIG. 2A illustrates the first method. A bottom recess of the emitter electrode manufactured as shown in FIG. 1F is filled with a planarizing film 19*a* of, for example, an SOG film. Thereafter, the planarizing film 19*a* is abraded by chemical mechanical polishing (CMP) or by etch-back to planarize the bottom surface of the emitter electrode 17. The planarizing film 19*a* may be formed by reflowing PSG or BPSG instead of using the SOG film.

Next, a support substrate 18 is adhered to the emitter electrode 17. The support substrate 18 is made of, for example, glass, quartz, or $Al_2O_3$. Thereafter, the process illustrated in FIG. 1G is performed.

FIG. 2B illustrates the second method. Adhesive 19*b* such as low melting point glass is reflowed on the emitter electrode in the state shown in FIG. 1F to adhere the emitter electrode 17 and a support substrate 18 together. Thereafter, the process illustrated in FIG. 1G is performed. The adhesive 19*b* also serves to planarize the bottom surface of the emitter electrode 17.

In place of the low melting point glass, Al may be used as the adhesive 19*b*. In this case, the emitter electrode 17 and support substrate 18 may be adhered by anodic bonding using electrostatic forces generated upon application of a high voltage of 1 kV and maintaining the temperature at 400° to 500° C. If Al is used as the adhesive 19*b*, the adhesive 19*b* may be used as an emitter wiring.

FIG. 2C illustrates the third method. The bottom recess of the emitter electrode in the state shown in FIG. 1F is filled with a planarizing film 19*a* made of, for example, W. Thereafter, the planarizing film 19*a* is etched back to planarize the bottom surface of the emitter electrode 17. A support substrate 18 is adhered to the emitter electrode 17 by using adhesive 19*b* such as Al. Thereafter, the process illustrated in FIG. 1G is performed.

In this embodiment, the process of forming the first sacrificial film 15*a* shown in FIG. 1D is important for determining the shape of the emitter electrode. For example, the distance between two parts of the first sacrificial film 15*a* is preferably about 0.1 $\mu$m. This distance between the two parts of the first sacrificial film 15*a* may be adjusted by another method described in the following.

Figure 3:
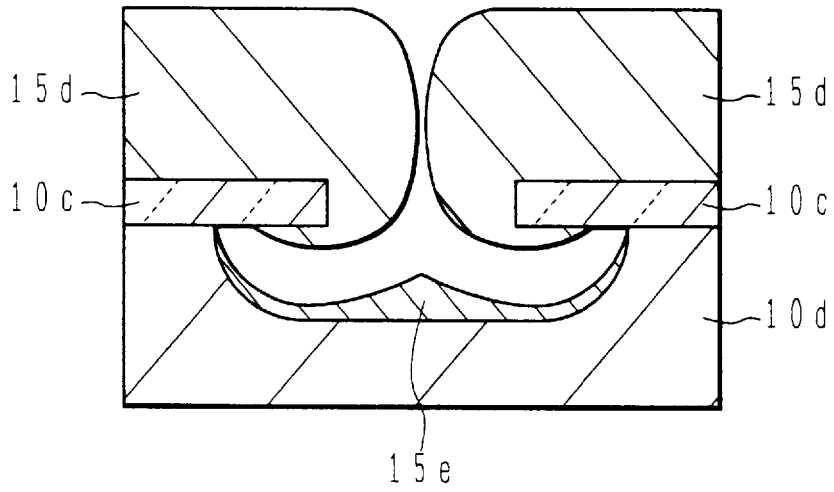
FIG. 3 is a diagram illustrating another method of forming a first sacrificial film.

FIG. 3 is a diagram illustrating a method of forming the first sacrificial film. After the process illustrated in FIG. 1G, first sacrificial films 15*d* and 15*e* are deposited thick by CVD or the like. The first sacrificial film 15*d* is controlled to have two parts. Thereafter, the thickness of the first sacrificial film 15*a* is adjusted to the thickness shown in FIG. 1D, by isotropic wet etching. This wet etching is performed by using, for example, $HG+HNO_3+H_2O$. The bottom surface of the overhang portion of the first sacrificial film 15*d* may be made thin. Thereafter, the processes starting from FIG. 1E are executed.

In the process illustrated in FIG. 1E, the reacted films 16*c* and 16*d* are formed by wet oxidation. Instead or wet oxidation, these reacted films may be formed by nitridation, anodic oxidation, silicide reaction, ion implantation, or the like. In the following, each of these methods will be described.

With nitridation, the reacted film 16*c* of $SiN_x$ can be formed from the first sacrificial film 15*a* of polysilicon. For example, nitridation is performed under the conditions of a temperature of 1050° C., an RF power of 10 kW, a pressure of 130 Pa, and a supply of $NH_3$ at 1 slm.

In order to oxidize the first sacrificial film 15*a* of Al through anodic oxidation, borate or phosphate may be used as electrolytic solution, and a voltage of 10 to 80 V is applied between the anode Al and a carbon cathode.

Next, the methods of forming a reacted film through silicide reaction and ion implantation will be described with reference to FIGS. 4A to 4E and FIGS. 5A to 5C.

FIGS. 4A to 4E illustrate the method of manufacturing a field emission element by using silicide reaction.

Figure 4A:
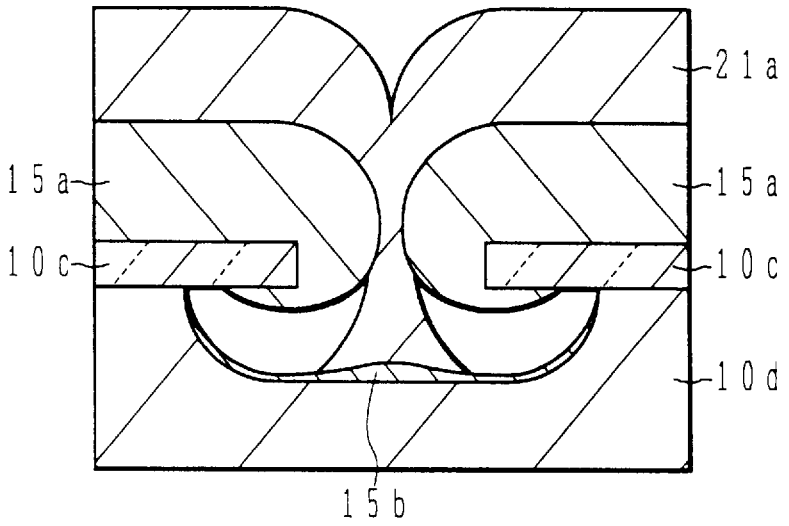
FIGS. 4A to 4E are diagrams illustrating the manufacture steps of a field emission element according to another embodiment of the invention.

The process illustrated in FIG. 4A follows the process illustrated in FIG. 1D. On the first sacrificial film 15*a* made of, for example, polysilicon or amorphous silicon, a second sacrificial film 21*a* made of, for example, Ti is formed. Instead of Ti, the second sacrificial film 21*a* may be made of refractory metal such as Ta, Mo, and W. In this specification, refractory metal includes Ti, Ta, Mo, and W.

Figure 4B:
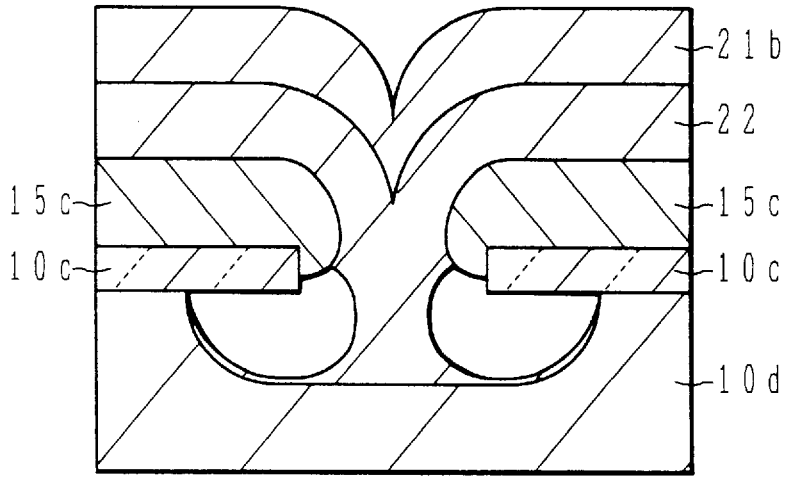

Next, as shown in FIG. 4B, as the substrate is heated to 400° to 600° C., silicide reaction proceeds and a reacted film 22 of TiSi is formed between the first sacrificial film 15*c* of Si and the second sacrificial film 21*b* of Ti.

Figure 4C:
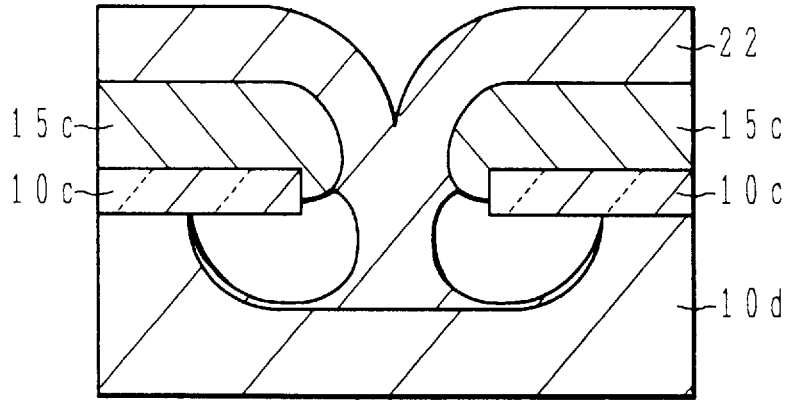

The second sacrificial film 21*b* is etched by sulfuric acid to expose the surface of the reacted film 22 as shown in FIG. 4C. By using the valley formed on the surface of the reacted film 22 as a mold, an emitter electrode is formed.

Figure 4D:
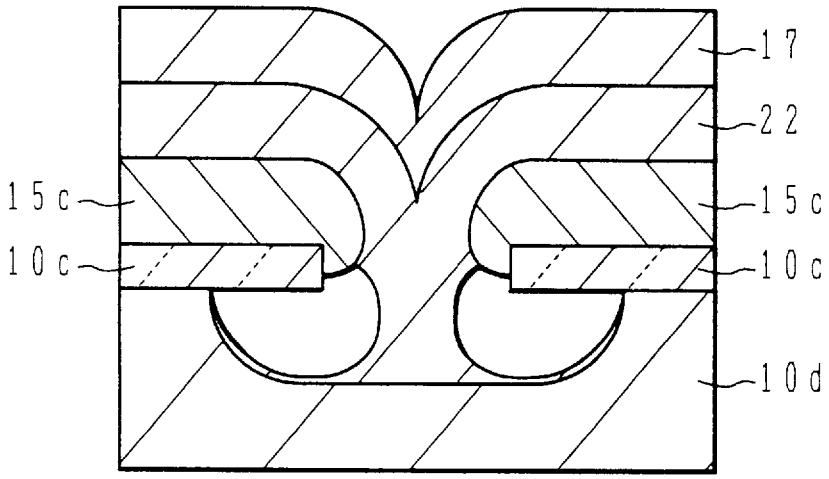
Figure 4E:
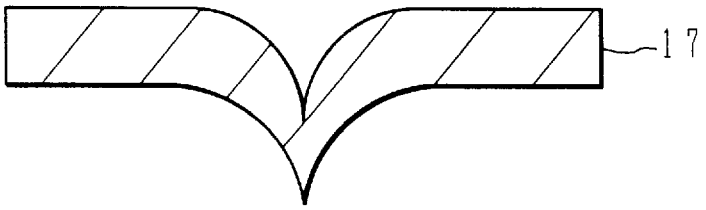

As shown in FIG. 4D, an emitter electrode 17 made of, for example, TiN is formed on the reacted film 22. The reacted film 22 made of TiSi is etched by hydrofluoric acid to expose the tip of the emitter electrode 17 as shown in FIG. 4E.

Figure 5A:
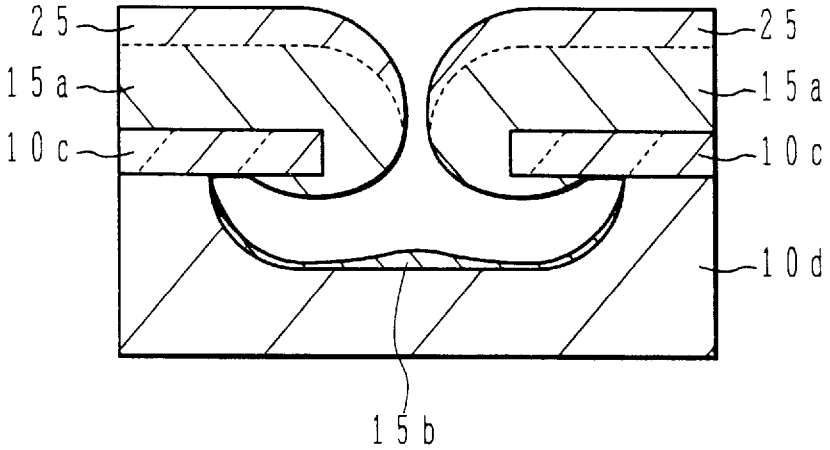
FIGS. 5A to 5C are diagrams illustrating the manufacture steps of a field emission element according to still another embodiment of the invention.
Figure 5B:
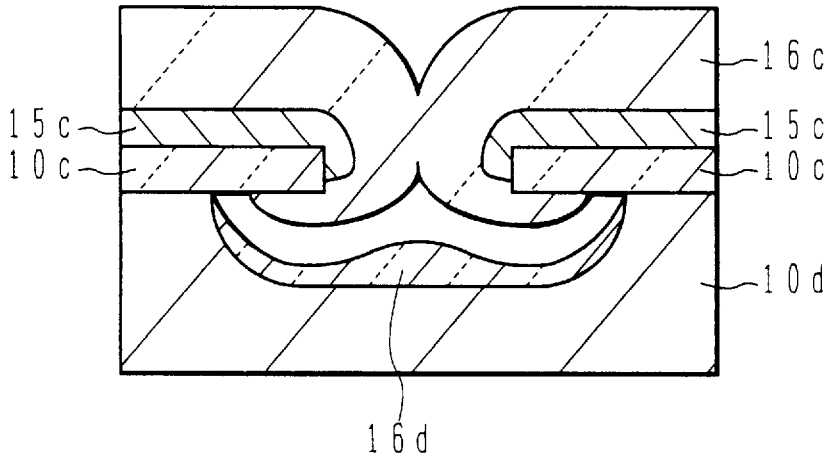
Figure 5C:
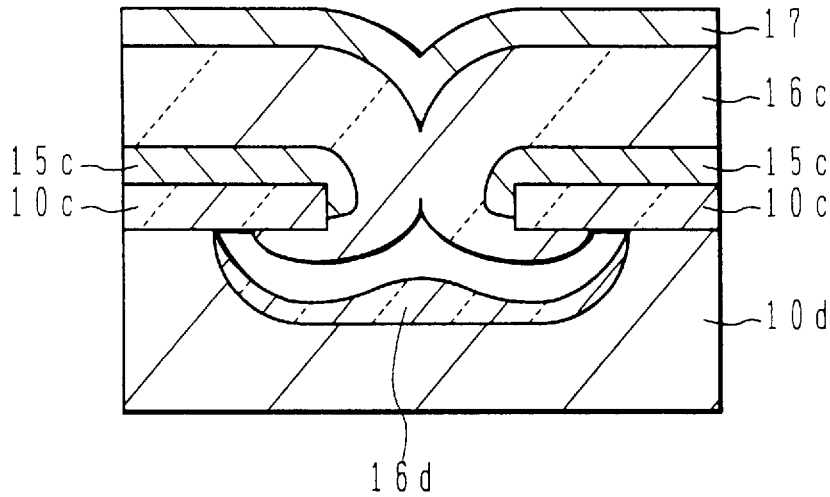

FIGS. 5A to 5C illustrate the method of manufacturing a field emission element by using ion implantation.

The process illustrated in FIG. 5A follows the process illustrated in FIG. 1D. Into the first sacrificial film 15*a* made of, for example, polysilicon or amorphous silicon, oxygen ions are implanted under the conditions of a dose of $1\times10^{18}$ $cm^{-2}$ and an acceleration energy of 20 to 40 keV to form an ion implanted layer 25 in the surface area of the first sacrificial film 15*a*. Instead of oxygen, nitrogen ions may be implanted.

Next, as shown in FIG. 5B, the substrate is annealed to grow oxide films 16*c* and 16*d* in an oxygen ambient. A first sacrificial film 15*c* corresponds to a portion of the first sacrificial film 15*a* shown in FIG. 5A not oxidized.

In the oxygen ion implanted layer 25, an oxide film grows fast. As the oxide film 16*c* grows, the two parts of the first sacrificial film 15*a* contact each other. By using a valley formed at the contact area as a mold, an emitter electrode is formed.

As shown in FIG. 5C, an emitter electrode 17 made of, for example, TiN is formed on the oxide film 16*c*. Thereafter, the oxide film 16*c* is wet etched by $HF+NH_4F$ to expose the tip of the emitter electrode 17 in such a manner as illustrated in FIGS. 1G and 4F.

In the description with reference to FIGS. 5A, B impurity ions (reaction species) such as oxygen and nitrogen are implanted into the surface area of the first sacrificial film 15*a*. Ions may be implanted into the intermediate area in depth of the first sacrificial film 15*a* and the impurity concentration of the surface area may be made low, by changing the ion implantation conditions.

As will be described later, the first sacrificial film 15*c* shown in FIG. 5C is used as the gate electrode of a two-electrode or three-electrode element. If ions are implanted into the surface area of the first sacrificial film 15*a* shown in FIG. 5A, the tip of the emitter electrode 17 is formed at a relatively high position, and the distance (gate diameter) between the two parts of the gate electrode 15*c* becomes short.

If ions are implanted into the relatively deep area of the first sacrificial film 15*a*, the tip of the emitter electrode 17 is formed at a relatively low position, and the distance (gate diameter) between the two parts of the gate electrode 15*c* becomes long.

The emitter electrode manufacture methods have been described so far. Next, a method of manufacturing another type of a field emission element of a two-electrode element will be described.

Figure 6:
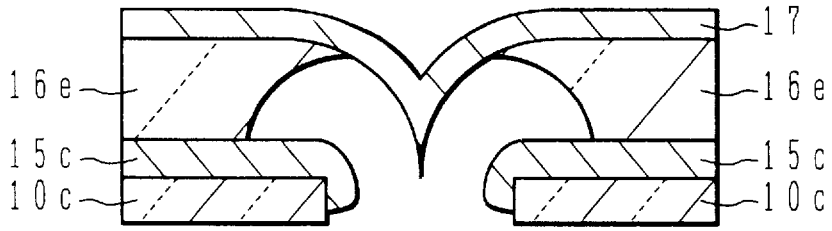
FIG. 6 is a diagram illustrating the manufacture steps of a two-electrode field emission element according to an embodiment of the invention.

FIG. 6 is a diagram illustrate the method of manufacturing a two-electrode element (so-called a diode). First, an element shown in FIG. 1F is formed by the above described processes. Thereafter, the substrate 10*d*, reacted film 16*d*, and part of the reacted film 16*c* are etched. By partially removing the reacted film 16*c* and leaving the reacted film 16*e* unetched as shown in FIG. 6, the tip of the emitter electrode 17 is exposed. The substrate 10*d* is etched, for example, by $HF+HNO_3+H_2O$, and the reacted films are etched, for example, by $HF+NH_4F$.

If the first sacrificial film is made of conductive polysilicon or amorphous silicon, the first sacrificial film 15*c*, which is unreacted, can be used as a gate electrode. The two-electrode element has two electrodes—the emitter electrode 17 and gate electrode 15*c*. The reacted film 16*e* electrically isolates the emitter electrode 17 and gate electrode 15*c*. The lamination film 10*c* may be removed by etching.

A relative position of the emitter electrode 17 and gate electrode 15*c* plays an important role of a two-electrode element. A shorter distance between the emitter electrode 17 and gate electrode 15*c* is principally better. It is therefore desired to position the tip of the emitter electrode 17 near at a straight line interconnecting the two parts of the gate electrodes 15*c*.

Figure 7A:
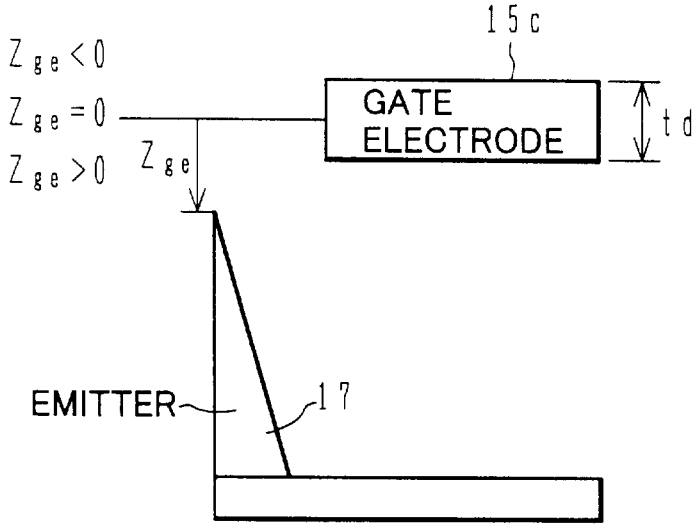
FIG. 7A is a schematic diagram showing a relative position of emitter and gate electrodes.

FIG. 7A is a schematic diagram showing the relative position of the gate electrode 15*c* and emitter electrode 17. The relative position is turned upside down from that shown in FIG. 6. A distance Zge is a distance from the tip of the emitter electrode 17 to the center of a thickness td of the gate electrode 15*c*, along an electron emission direction.

Figure 7B:
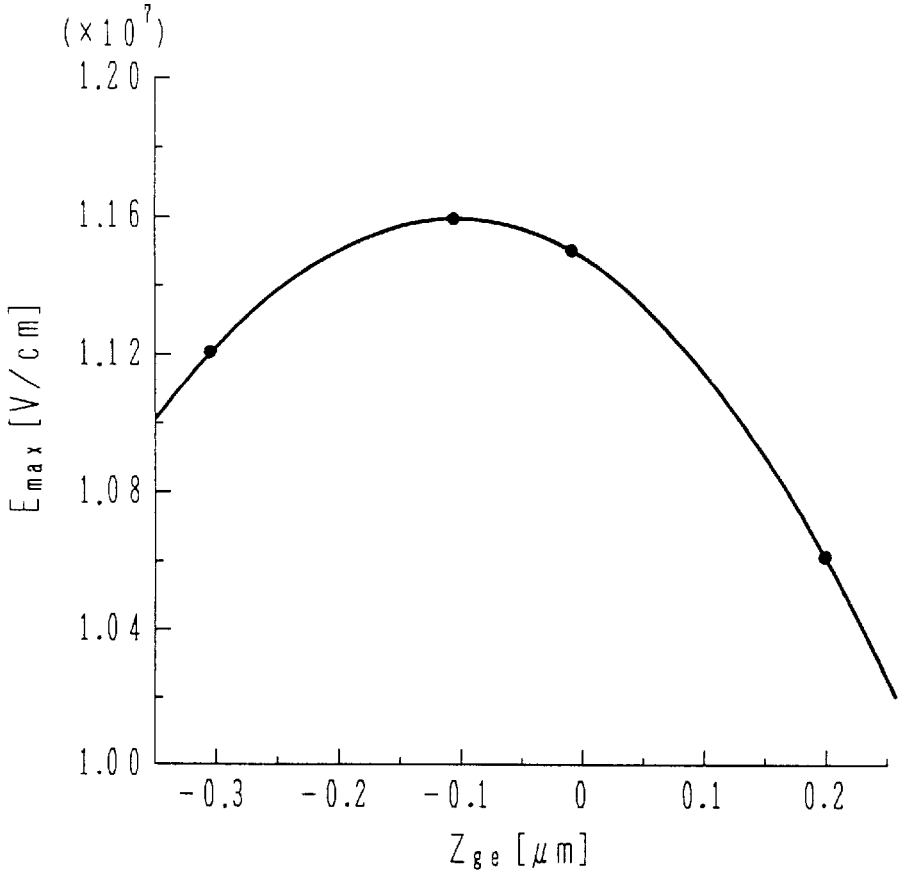
FIG. 7B is a graph showing a relationship between a distance between emitter and gate electrodes and a maximum field intensity.

FIG. 7B is a graph showing a relationship between the distance Zge and a maximum field intensity Emax at the tip of the emitter electrode, with the thickness td of the gate electrode 15*c* being fixed to 0.4 $\mu$m. The abscissa represents the distance Zge, and the ordinate represents the maximum field intensity Emax.

This graph shows a change in the maximum field intensity Emax of the emitter electrode as the distance Zge between the emitter and gate electrodes is changed from −0.35 $\mu$m to 0.25 $\mu$m. The larger the maximum field intensity Emax, the more the electric field concentrates on the tip of the emitter electrode and the more the performance of the field emission element is improved. At the distance Zge of −0.1 $\mu$m, the maximum field intensity Emax takes an extreme value of $1.16\times10^7$ V/cm. Namely, the optimum position of the tip of the emitter electrode 17 is slightly higher in FIG. 7A (slightly lower in FIG. 6) than the center of the thickness of the gate electrode.

The two-electrode element uses the emitter electrode 17 as a cathode and the gage electrode 15*c* as a control electrode. If the tip of the emitter electrode 17 is set to a proper position, electrons can be easily emitted from the tip of the emitter electrode 17 even at a low control voltage applied to the gate electrode.

The two-electrode element has the emitter electrode 17 with a small apex angle and radius of curvature of the tip so that the performance of the field emission element can be improved.

Figure 8:
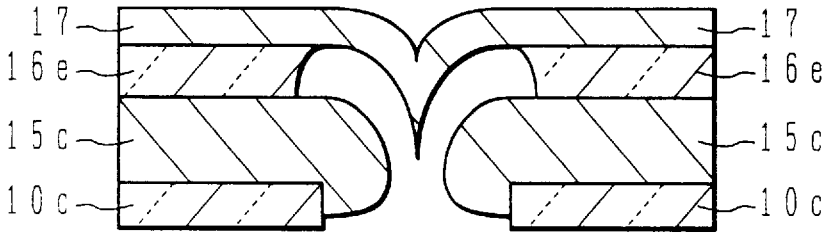
FIG. 8 is a diagram illustrating the manufacture steps of a two-electrode field emission element according to another embodiment of the invention.

FIG. 8 shows another example of a two-electrode element. In this two electrode element, the thicknesses of the gate electrode (first sacrificial film) 15*c* and the insulating film (reacted film) 16*e* are different from those of the two-electrode element shown in FIG. 6. The thicknesses of the gate electrode 15*c* and insulating film 15*e* can be controlled by changing the thickness of the first sacrificial film deposited on the lamination film 10*c* and by changing a reaction time or method of the first sacrificial film.

The two-electrode element shown in FIG. 8 has the gate electrode (first sacrificial film) 15*c* thicker than that of the two-electrode element shown in FIG. 6 and has a smaller diameter of the gate hole than that of the element shown in FIG. 6. In order to increase the thickness of the gate electrode (first sacrificial film) 15*c*, the first sacrificial film 15*a* shown in FIG. 1D is deposited more anisotropically. Anisotropic deposition of the first sacrificial film 15*a* reduces the diameter of the gate hole. Therefore, even at a low gate-emitter voltage, electrons can be emitted from the emitter electrode. Similar advantages are also obtained by a three-electrode element to be described later.

The first sacrificial film 15*a* shown in FIG. 1D is anisotropically deposited on the lamination film 10*c*. This film 15*a* may be deposited isotropically. However, anisotropic deposition makes the diameter of the hole (gate hole) of the gate electrode smaller and can improve the electrical characteristics.

If the first sacrificial film is isotropically deposited at the process of FIG. 1D, the first sacrificial film 15*a* deposited at the overhang portion is likely to be integrated with the first sacrificial film 15*b* deposited on the substrate 10*d*. It is therefore difficult to form the first sacrificial film 15*a* having two parts.

According to this embodiment, after the first sacrificial film is formed, it is subjected to chemical reaction to expand its volume so that the position of the tip of the emitter electrode 17 can be controlled precisely.

A film formed by CVD becomes thick approximately proportional to time. In contrast, a film formed by chemical reaction such as oxidation becomes thick approximately proportional to a square root of time. In other words, the film thickness tends to saturate as the time lapses. With oxidation or the like, the film thickness can be controlled more finely and the tip position of the emitter electrode can be controlled more precisely, the more the time lapses. Furthermore, a film having a better uniform quality can be formed by oxidation than CVD.

Figure 9A:
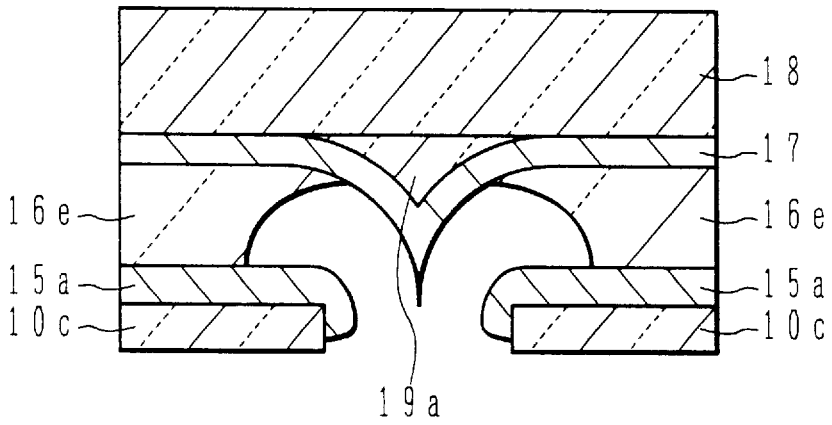
FIGS. 9A to 9C are diagrams illustrating three methods of reinforcing a two-electrode field emission element with a support substrate.
Figure 9B:
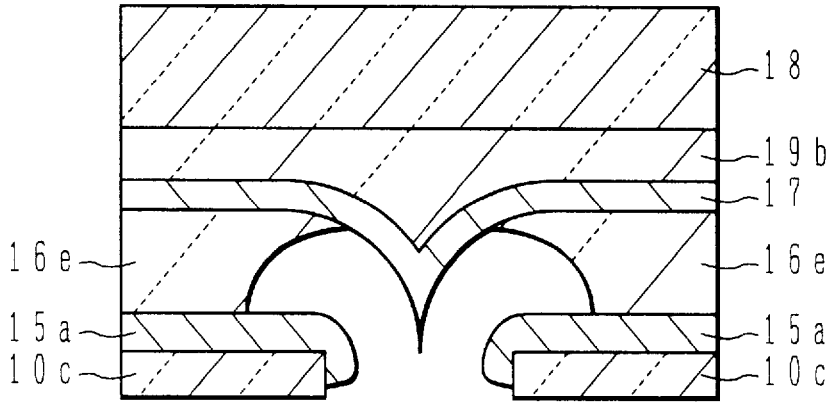
Figure 9C:
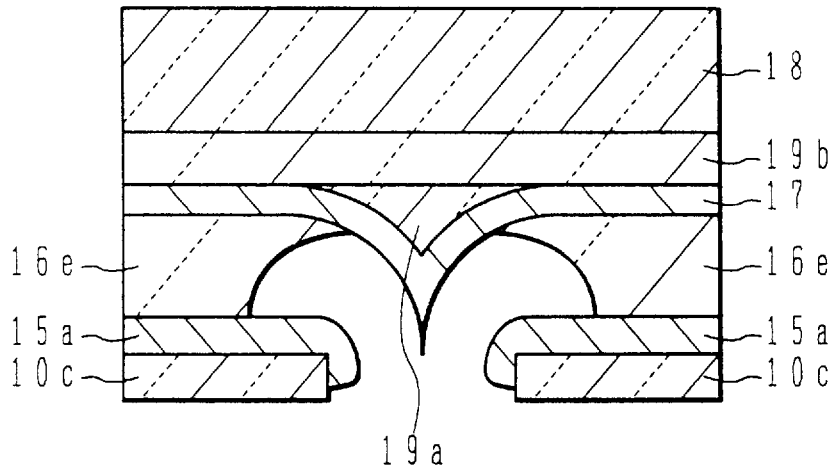

FIGS. 9A to 9C are diagrams illustrating three methods of reinforcing a two-electrode element with a support substrate 18, similar to the methods described with FIGS. 2A to 2C.

FIG. 9A illustrates the first method. A bottom recess of the emitter electrode 17 is filled with a planarizing film 19*a* of, for example, an SOG film, a PSG film, or a BPSG film. Thereafter, the planarizing film 19*a* is etched back by CMP to planarize the bottom surface of the emitter electrode 17. Next, a support substrate 18 is adhered to the emitter electrode 17. The support substrate 18 is made of, for example, glass, quartz, or $Al_2O_3$.

FIG. 9B illustrates the second method. Adhesive 19*b* such as low melting point glass is reflowed on the emitter electrode 17 to planarize the bottom surface of the emitter and adhere the emitter electrode 17 and a support substrate 18 together. Al may be used as the adhesive 19*b* to anodically bond the emitter electrode 17 and support substrate 18.

FIG. 9C illustrates the third method. The bottom recess of the emitter electrode is filled with a planarizing film 19*a* made of, for example, W. Thereafter, the planarizing film 19*a* is etched back to planarize the bottom surface of the emitter electrode 17. A support substrate 18 is adhered to the emitter electrode 17 by using adhesive 19*b* such as Al.

The manufacture method of a two-electrode element has been described. Next, a manufacture method of another type of a field emission element of a three-electrode element will be described.

Figure 10A:
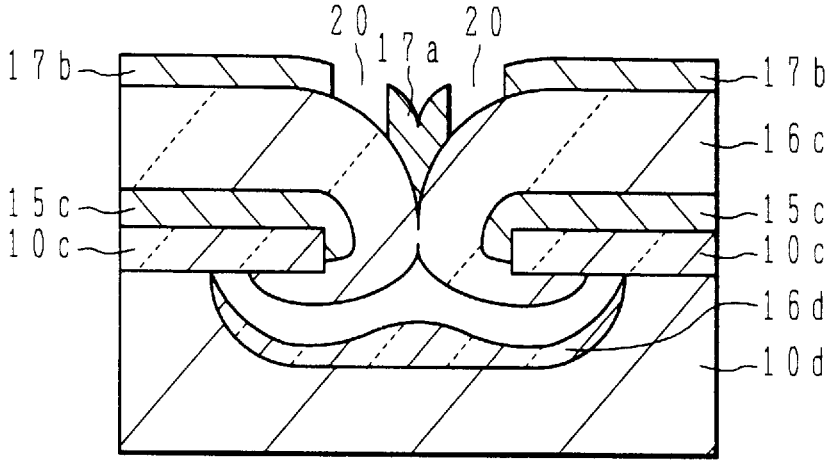
FIGS. 10A to 10C are diagrams illustrating the manufacture steps of a three-electrode field emission element according to an embodiment of the invention.
Figure 10B:
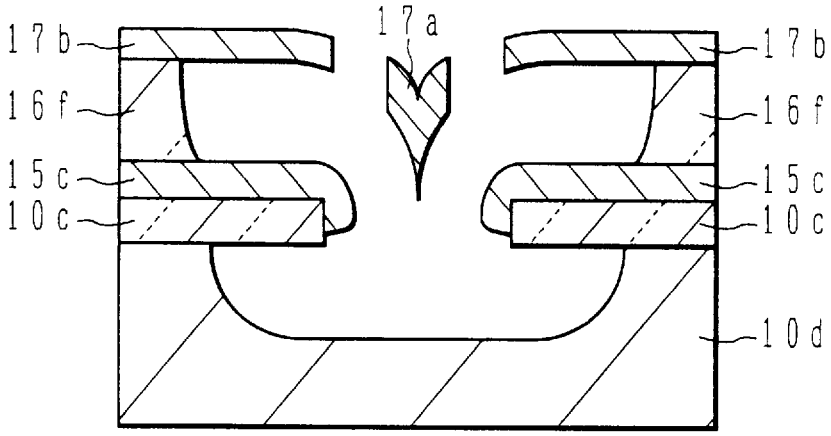
Figure 10C:
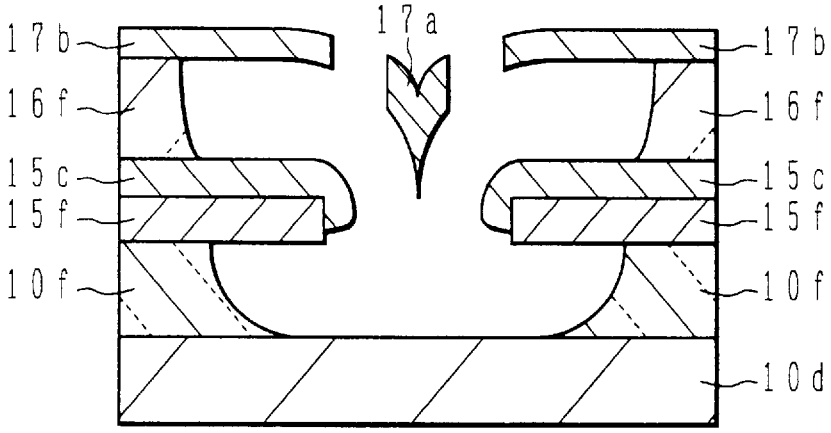

FIGS. 10A to 10C are diagrams illustrating a method of manufacturing a three-electrode element (so-called a triode).

First, the element shown in FIG. 1F is manufactured by the previously described processes. Thereafter, a resist film having a predetermined pattern (not shown) is formed on the emitter electrode 17. By using this resist pattern as a mask, slit openings 20 are formed on both sides of an emitter electrode 17*a* by RIE using $Cl_2$ containing etchant. An emitter electrode 17*b* is formed at the outer sides of the slit openings 20.

The diameter of the emitter electrode 17*a* is about 0.3 $\mu$m, and the depth of the slit openings is about 0.2 $\mu$m.

Next, part of the reacted film 16*c* and the whole of the reacted film 16*d* are wet etched. For example, $HF+NH_4F$ is used for wet etching the reacted films 16*c* and 16*d* made of $SiO_2$.

Part of the reacted film 16*c* is etched and a reacted film 16*f* is left unetched as shown in FIG. 10B so that the emitter electrode 17*a*, gate electrode 15*c*, and anode electrode 10*d* are exposed.

Figure 11:
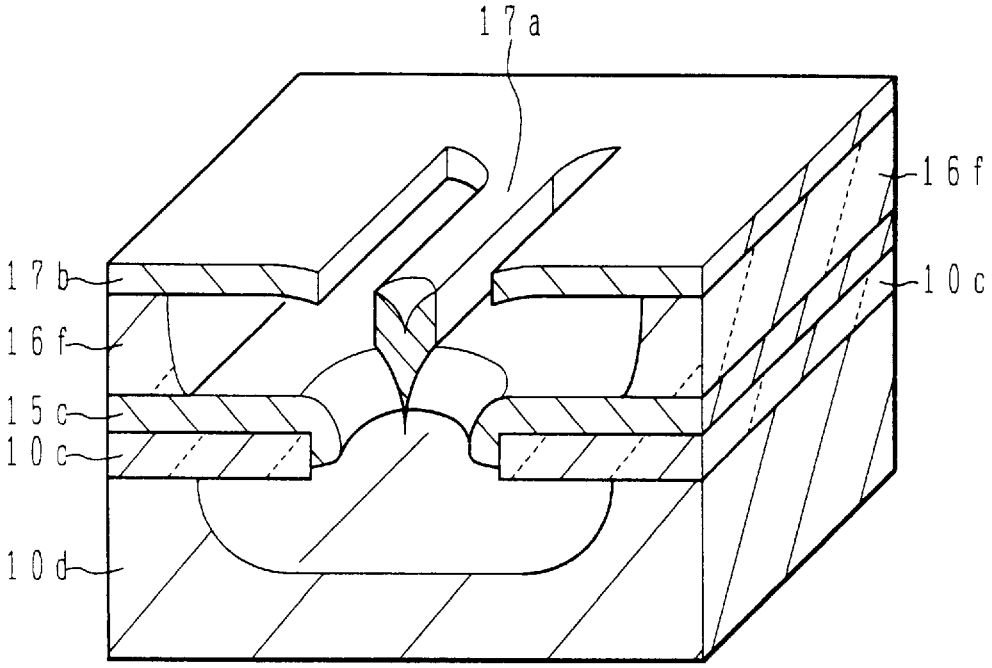
FIG. 11 is a perspective view of a three-electrode field emission element according to an embodiment of the invention.

FIG. 11 is a perspective view of a three-electrode element. The emitter electrode 17*a* is integrally formed with the emitter electrode 17*b*. The gate electrode 15*c* has a circular hole (gate hole) near at the tip of the emitter electrode 17*a*. The tip of the emitter electrode 17*a* has a needle-like sharp edge near at the gate hole of the gate electrode 15*c*.

Figure 12A:
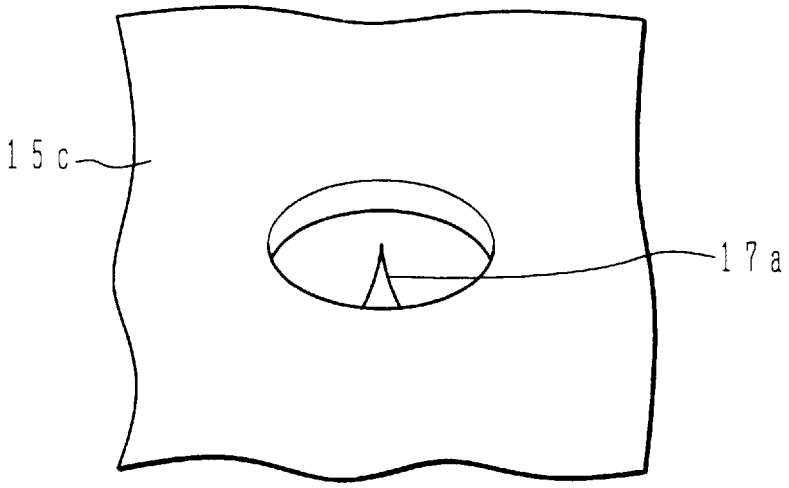
FIGS. 12A and 12B are diagrams showing the three-electrode field emission element shown in FIG. 11 turned upside down.

FIG. 12 is a perspective view showing the three-electrode element shown in FIG. 11 turned upside down, the emitter electrode 17*a* being viewed through the substrate via the gate hole of the gate electrode. The tip of the emitter electrode 17*a* has a needle-like sharp edge. The tip of the emitter electrode 17*a* may be have different shapes.

Figure 12B:
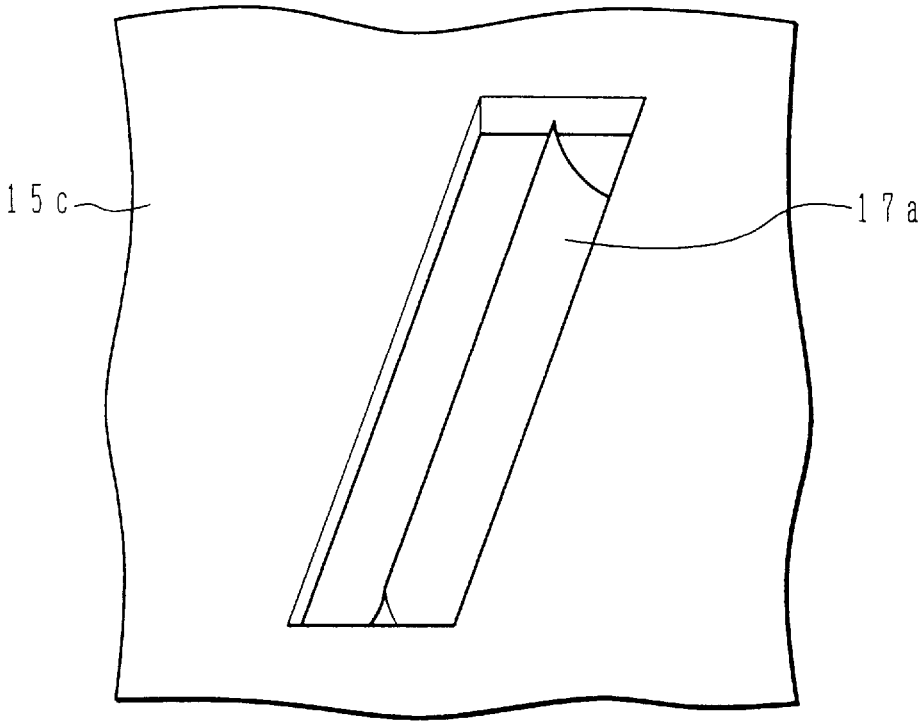

FIG. 12B is a perspective view showing a three-electrode element having a slit gate hole of the gate electrode 15*c*. The emitter electrode 17*a* has a wedge-like tip extending along the longitudinal direction of the gate hole.

The three-electrode element shown in FIG. 11 has the emitter electrode 17 as a cathode and an anode electrode 10*d* wherein a positive potential is applied to the gate electrode 15*c* to emit electrons from the emitter electrode 17*a* toward the anode electrode 10*d*.

Also in the case of a three-electrode element, the apex angle and radius of curvature of the tip of the emitter electrode 17*a* can be made small. The relative position of the emitter electrode 17*a* and gate electrode 15*c* can be controlled precisely.

In the above description, the lamination film 10*c* is made of insulating material such as $SiN_x$. Next, forming the lamination film 10*c* by conductive material will be described.

FIG. 10C is a cross sectional view showing another example of a three-electrode element. A lamination film (first gate electrode) 15*f* is made of conductive material such as $WSi_x$, $TaSi_x$, and $MoSi_x$. Between the anode electrode 10*d* and lamination film 15*f*, an insulating film 10*f* made of $SiO_2$, $SiN_x$, or the like is formed. The manufacture method of this three-electrode element will be described next.

The substrate 10 shown in FIG. 1A is constituted of the starting substrate 10*a* and the lamination film 10*b* of insulating material stacked on the starting substrate 10*a*. In the case of the three-electrode element shown in FIG. 10C, on a substrate 10*d* made of, for example, Si, an insulating film 10*f* made of $SiO_2$ or the like and a lamination film 15*f* made of conductive material are sequentially laminated. Thereafter, the processes described previously are performed to manufacture the three-electrode element shown in FIG. 10C.

By using the conductive lamination film 15*f*, a lamination of the first gate electrode 15*f* and second gate electrode 15*c* forms a low resistance gate electrode. The gate electrodes 15*f* and 15*c* are electrically isolated from the anode electrode 10*d* by the insulating film 10*f*.

Figure 13:
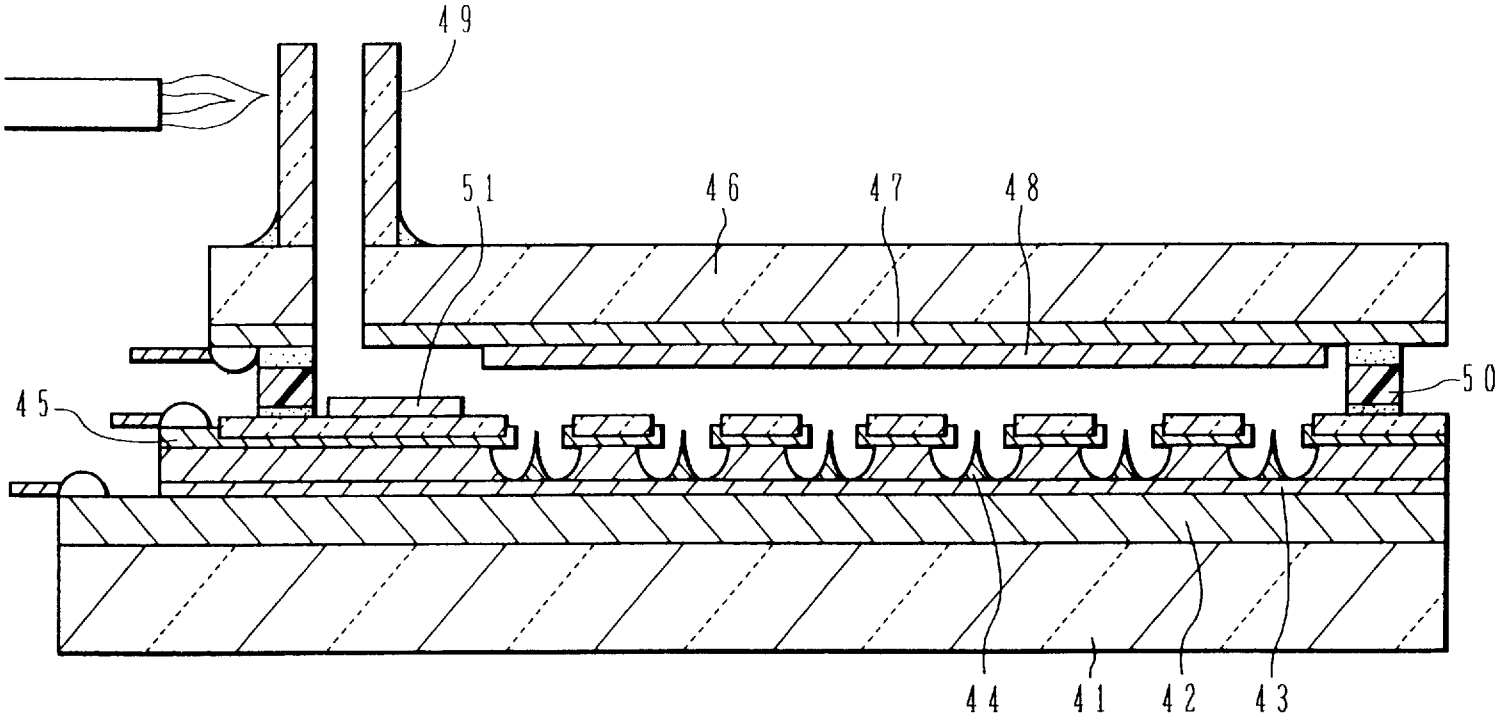
FIG. 13 is a cross sectional view of a flat panel display using field emission elements.

FIG. 13 is a cross sectional view of a flat panel display using field emission elements.

Each field emission element used is an emitter electrode or a two-electrode element formed by the embodiment manufacture method. On a support substrate 41 made of insulating material, a wiring layer 42 made of Al, Cu, or the like and a resistor layer 43 made of polysilicon or the like are formed. On the resistor layer 43, a number of emitter electrodes having a small apex angle and radius of curvature of the emitter tip are disposed to form a field emitter array (FEA). Each gate electrode 45 has an opening (gate hole) near at the tip of each emitter electrode 44 and a voltage can be applied independently to each gate electrode. A plurality of emitter electrodes can also be independently applied with a voltage.

Facing an electron source including the emitter electrode 44 and gate electrode 45, an opposing substrate is disposed including a transparent substrate 46 made of glass, quartz, or the like. The opposing substrate has a transparent electrode (anode electrode) 47 made of ITO or the like disposed under the transparent electrode 46 and a fluorescent member 48 disposed under the transparent electrode 47.

The electron source and opposing substrate are joined together via a spacer 50 made of a glass substrate and coated with adhesive, with the distance between the transparent electrode 47 and emitter electrode 44 being maintained about 0.1 to 5 mm. The adhesive may be low melting point glass.

Instead of the spacer 50 of a glass substrate, a spacer 50 made of adhesive such as epoxy resin with glass beads being dispersed therein may be used.

A getter member 51 is made of Ti, Al, Mg, or the like and prevents emitted gas from attaching again to the surface of the emitter electrode 44.

An air exhaust pipe 49 is coupled to the opposing substrate. By using this air exhaust pipe 49, the inside of the flat display panel is evacuated to about $10^{-5}$ to $10^{-9}$ Torr, and then the air exhaust pipe 49 is sealed by using a burner or the like. Thereafter, the anode electrode (transparent electrode) 47, emitter electrode 44, gate electrode 45 are wired to complete the flat panel display.

Figure 14:
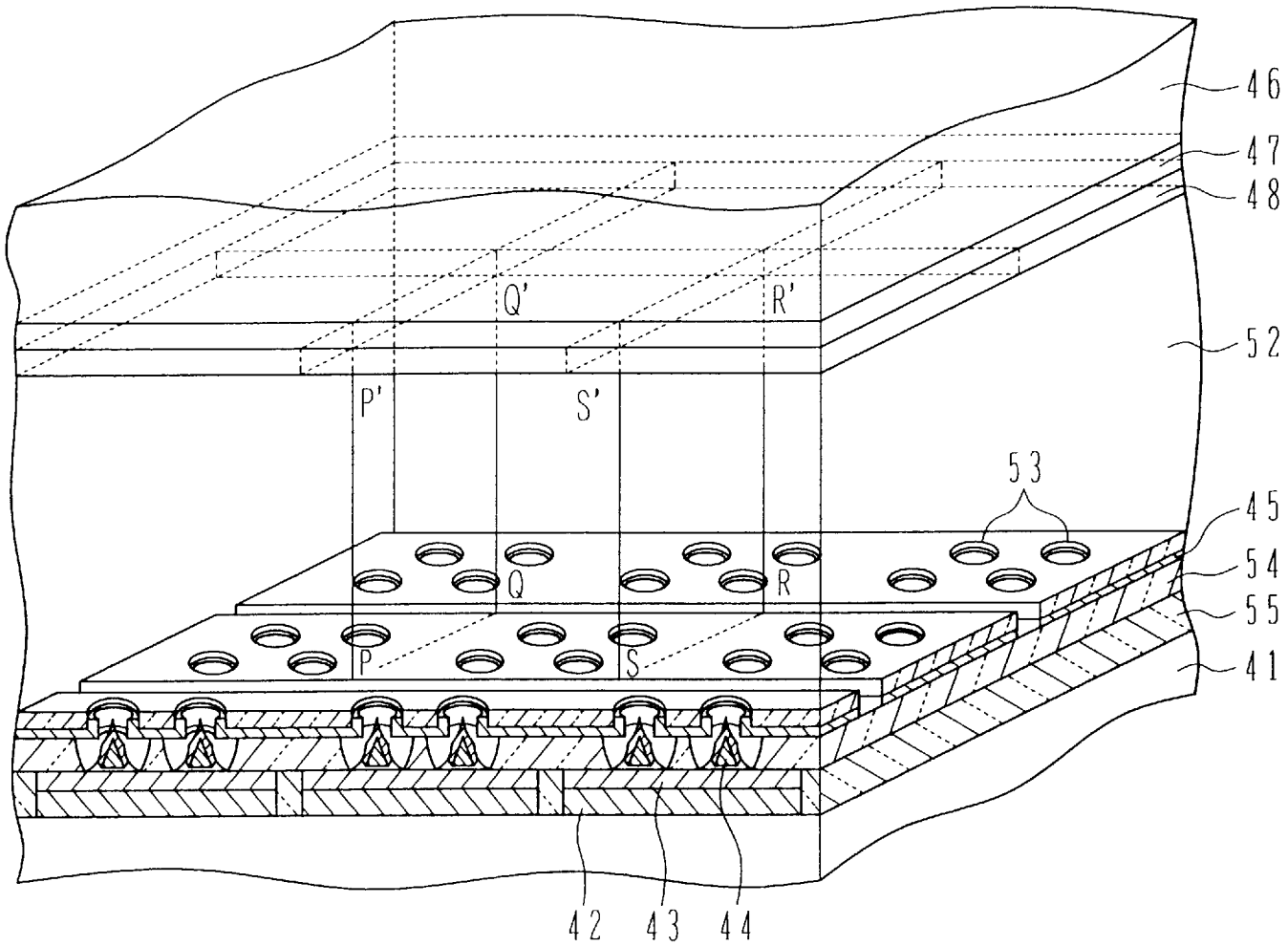
FIG. 14 is a perspective view partially in section of a flat panel display using field emission elements.

FIG. 14 is a perspective view of a flat panel display. A gate electrode 45 has a number of gate holes 53. An emitter electrode 44 is formed in one-to-one correspondence with each gate hole 53. Each emitter electrode is partitioned by an insulating film 54. Electrons emitted from the emitter electrode 44 pass through a vacuum hollow space 52 and collide with a fluorescent member 48 to radiate light therefrom.

The flat panel display is constituted of a plurality of pixels. Each pixel is constituted of a region PQRS made of four emitter electrodes 44 and a corresponding region P'Q'R'S' of the opposing substrate.

A resistor Layer 43 and a wiring layer 42 formed under the emitter electrodes 44 are partitioned by a planarizing film (insulating film) 55 in unit of pixel (four emitter electrodes).

Figure 15:
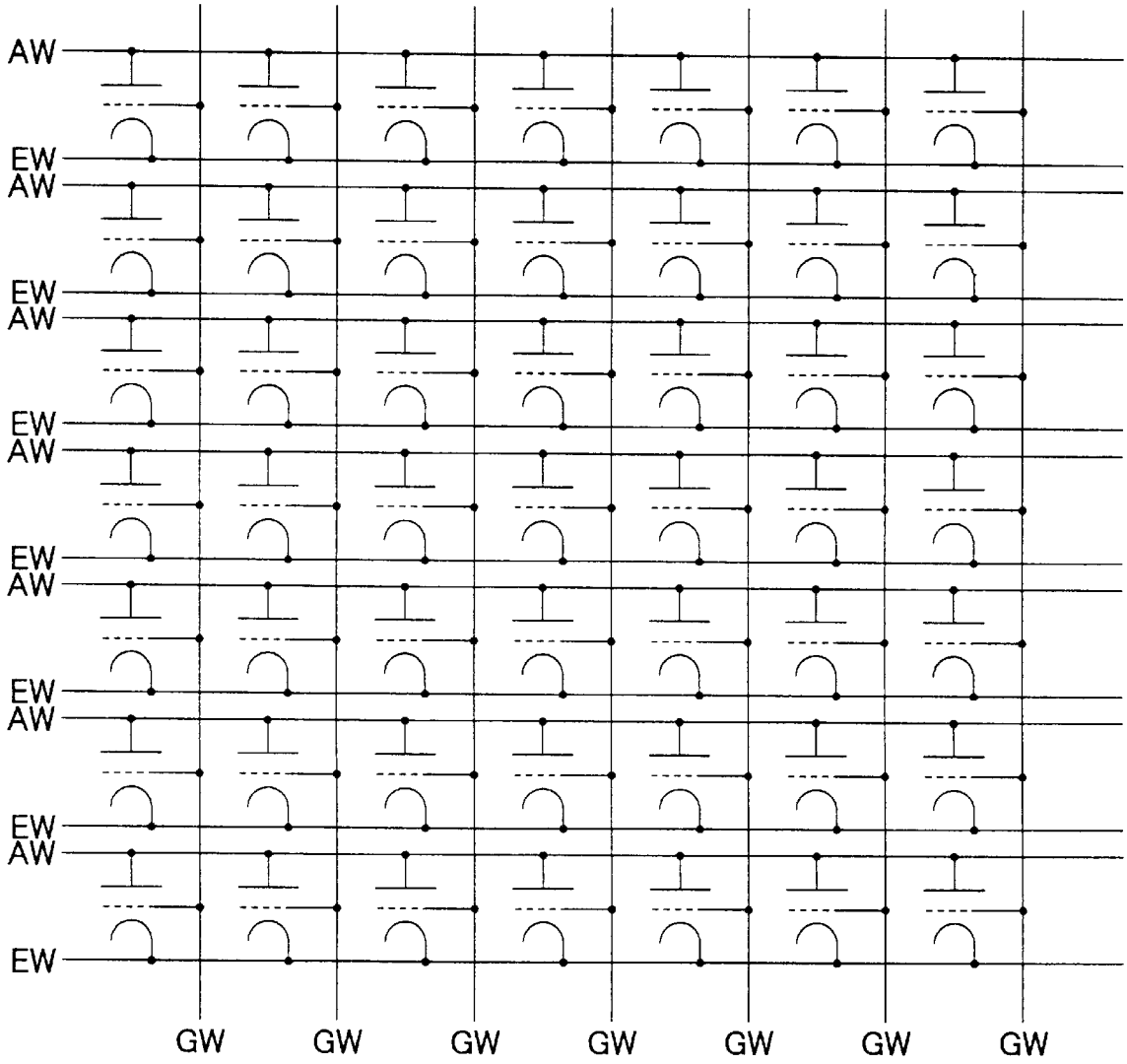
FIG. 15 is a circuit diagram of a flat panel display.
Figure 16A:
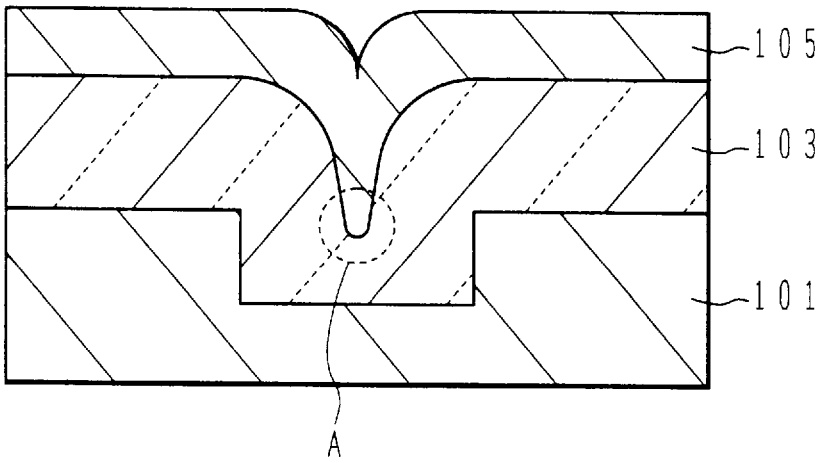
FIG.16A PRIOR ART
FIGS. 16A and 16B are cross sectional views of conventional field emission elements.
Figure 16B:
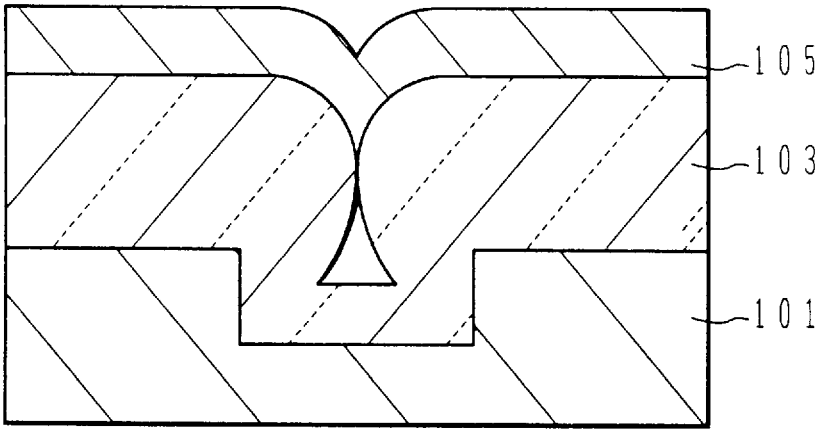
FIG.16B PRIOR ART

FIG. 15 is an equivalent circuit diagram of a flat panel display which is made of a field emitter array (FEA) having a number of triodes.

A number of triodes are disposed at cross points between two-dimensionally patterned emitter wirings EW and gate wirings GW. The anode wiring AW of an anode electrode (transparent substrate) 47 of each triode is always maintained at a positive potential. The triodes are two-dimensionally disposed by the emitter wirings EW and gate wirings GW, and the triode at the cross point of the voltage-applied emitter wiring EW and gate wiring GW is selected.

The emitter electrode and gate electrode of the selected triode are applied with negative and positive potentials, respectively, so that electrons are emitted from the emitter electrode to the anode electrode.

In the above embodiments, the volume of the first sacrificial film having two parts is expanded by chemical reaction to make the two parts contact with each other and form an acute angle valley at the contact area. By using this valley as a mold, an emitter electrode having a small apex angle and radius of curvature of the emitter tip can be formed.

The relative position of the emitter electrode and gate electrode can be determined precisely.

The distance (gate diameter) of the two parts of the gate electrode can be shortened by forming the gate electrode on the overhang portion of the lamination film 10*c*. Therefore, the control voltage to be applied to the gate electrode can be lowered and the performance of the field emission element can be improved.

The present invention has been described in connection with the preferred embodiments. The invention is not limited only to the above embodiments. It is apparent that various modifications, improvements, combinations, and the like can be made by those skilled in the art.

I claim:

1. A method for fabricating a field emission apparatus, comprising the steps of:

a) providing a substrate having a mask layer thereon;

b) selectively removing the mask Layer to provide a window;

c) isotropically removing the substrate through the window to provide a hollow space in the substrate, wherein the follow space laterally spreads through the window to the underneath of the mask layer;

d) providing a sacrificial layer over the window and the mask layer so as to provide sacrificial films laterally separated along a horizontal direction of the substrate;

e) at Least partially reacting the sacrificial films in such a manner that the reacted sacrificial films are brought into contact with therewith after the completion of the reaction so as to provide a cusp mold on the reacted sacrificial films; and f) providing an electron emitting layer over the reacted sacrificial films.

2. A method according to claim 1, wherein the mask layer is made of a material selected from a group consisting of $SiN_x$, $SiO_2$, $AlN_x$, and $Al_2O_3$.

3. A method according to claim 1, wherein the substrate is made of a material selected from a group consisting of Si and Al.

4. A method according to claim 1, wherein the sacrificial layer is made of polysilicon.

5. A method according to claim 1, wherein the step d) is performed by wet oxidation.

6. A method according to claim 1, wherein the electron emitting layer is made of TiN.

7. A method according to claim 1, further comprising the stop of:

d-1) implanting ions into the sacrificial films, following the step d).

8. A method according to claim 5, wherein the reacted sacrificial films are made of $SiO_2$.

9. A method for fabricating a field emission apparatus, comprising the steps of:

a) providing a substrate having a mask layer thereon;

b) selectively removing the mask layer to provide a window;

c) isotropically removing the substrate through the window to provide a hollow space in the substrate, wherein the follow space laterally spreads through the window to the underneath of the mask layer;

d) providing a first sacrificial layer over the window and the mask layer so as to provide sacrificial films laterally separated along a horizontal direction of the substrate;

e) providing a second sacrificial layer on the sacrificial films;

f) at least partially reacting the sacrificial films with the second sacrificial layer to provide a cusp mold on the reacted sacrificial films; and g) providing an electron emitting layer over the reacted sacrificial films.

10. A method according to claim 9, wherein the first sacrificial layer is made of a material selected from a group consisting of polysilicon and amorphous silicon.

11. A method according to claim 9, wherein the second sacrificial layer is made of a material selected from a group consisting of Ti, Ta, Mo, and W.

12. A method according to claim 9, further comprising the step of:

f-1) removing an unreacted portion of the second sacrificial layer, following the step f).

13. A method for fabricating a field emission apparatus, comprising the steps of:

a) providing a substrate having a mask layer thereon;

b) selectively removing the mask layer to provide a window;

c) isotropically removing the substrate through the window to provide a hollow space in the substrate, wherein the hollow space laterally spreads through the window to the underneath of the mask layer;

d) providing a sacrificial layer over the window and the mask layer so as to provide sacrificial films laterally separated along a horizontal direction of the substrate;

e) reacting the sacrificial films in such a manner that the reacted sacrificial films are brought into contact therewith after the completion of the reaction so as to provide a cusp mold on the reacted sacrificial films while an unreacted portion of the sacrificial layer is remained under the reacted sacrificial films;

f) providing an electron emitting layer over the reacted sacrificial films;

g) forming holes in the electron emitting layer; and h) selectively removing the reacted sacrificial films through the holes in the electron emitting layer, wherein the unreacted portion of the sacrificial layer is served as a gate electrode.

14. A method according to claim 13, wherein the sacrificial layer is made of polysilicon.

15. A method according to claim 13, wherein the electron emitting layer is made of TiN.

16. A method according to claim 13, wherein the step h) is performed by wet etching.

* * * * *